US010036553B2

(12) United States Patent
Kramer

(10) Patent No.: US 10,036,553 B2
(45) Date of Patent: Jul. 31, 2018

(54) ROTATING FIRE PIT

(71) Applicant: Edward W. Kramer, West Berlin, NJ (US)

(72) Inventor: Edward W. Kramer, West Berlin, NJ (US)

( * ) Notice: Subject to any disclaimer, the term of this patent is extended or adjusted under 35 U.S.C. 154(b) by 554 days.

(21) Appl. No.: 14/490,770

(22) Filed: Sep. 19, 2014

(65) Prior Publication Data

US 2015/0075511 A1 Mar. 19, 2015

Related U.S. Application Data

(60) Provisional application No. 61/892,853, filed on Oct. 18, 2013, provisional application No. 61/880,032, filed on Sep. 19, 2013.

(51) Int. Cl.

| | |
|---|---|
| ***F23M 5/00*** | (2006.01) |
| ***F24B 1/19*** | (2006.01) |
| ***F24B 1/195*** | (2006.01) |

(52) U.S. Cl.

CPC ..... *F24B 1/19* (2013.01); *F24B 1/195* (2013.01)

(58) Field of Classification Search

CPC ..... F21S 10/00; F24B 1/197; F24B 1/198
See application file for complete search history.

(56) References Cited

U.S. PATENT DOCUMENTS

| | | | | |
|---|---|---|---|---|
| 3,990,238 | A | 11/1976 | Bailey | |
| 5,892,656 | A | 4/1999 | Bass | |
| 6,609,514 | B1 * | 8/2003 | Bertolas | F24B 1/1808 126/519 |
| 7,473,002 | B1 * | 1/2009 | Chen | F21S 10/00 362/283 |
| 2003/0034023 | A1 * | 2/2003 | Meurer | F24C 1/16 126/29 |
| 2006/0016446 | A1 * | 1/2006 | Hu | F24C 3/00 126/41 R |
| 2006/0165529 | A1 * | 7/2006 | Sobel | F04D 25/088 416/210 R |
| 2007/0097681 | A1 * | 5/2007 | Chich | F21S 10/00 362/232 |

OTHER PUBLICATIONS http://www.landmann-usa.com/store/fire-pits/fire-rings, Sep. 19, 2014.
http://www.avantgardendecor.com, Sep. 19, 2014.

* cited by examiner

*Primary Examiner* — Jason Lau
(74) *Attorney, Agent, or Firm* — Andrew G. Morabito, Esq.

(57) ABSTRACT

A rotating fire pit is provided. The fire pit includes a base for supporting a fire source. The fire pit further includes an enclosure circumscribing the fire source. The enclosure has a wall that includes a decorative cutout. The fire pit further includes a drive mechanism that drives relative motion between the base and a ground surface.

18 Claims, 8 Drawing Sheets

ROTATING FIRE PIT

CROSS REFERENCE TO RELATED APPLICATIONS

This application claims priority to U.S. provisional patent application No. 61/880,032 filed Sep. 19, 2013 and U.S. provisional patent application No. 61/892,853 filed Oct. 18, 2013, each of which is incorporated herein by reference in their entirety.

BACKGROUND OF THE INVENTION

The present invention relates generally to fire pits and more specifically to a rotating fire pit. Fire pits generally include an enclosure surrounding a fire which allows an individual to enjoy the warmth, light, and pleasing visual display of a fire source in relative safety as compared to a fire source without an enclosure.

BRIEF SUMMARY OF THE INVENTION

In an example of an embodiment of a fire pit as described herein, a fire pit includes a base for supporting a fire source. Such a fire pit further includes an enclosure circumscribing the fire source, the enclosure having a wall that includes a decorative cutout. Furthermore, the fire pit includes a drive mechanism that drives relative motion between the base and a ground surface.

In another example of an embodiment of a fire pit as described herein, a rotating fire pit includes a rotating base supporting a fire source and a fire ring circumscribing the fire source. In such a fire pit, the fire ring may include a decorative cutout.

In an example of an embodiment of a device for creating a fire tornado as described herein, the device includes a base supporting a fire source. Such a device further includes a drive mechanism for driving rotation of the base. The device further includes a fire ring circumscribing the fire source and the fire ring including a decorative cutout.

In an example, a method for creating a fire tornado is described herein. The method includes: providing a fire source supported by a base and providing an enclosure having a decorative cutout, wherein the enclosure circumscribes the fire source. The method further includes generating a circumferential airflow about the fire source by rotating the enclosure thereby generating a tornado effect on a flame provided by the fire source.

In an example of an embodiment of a device for creating a fire tornado as described herein, the device includes a base supporting a fire source. Such a device further includes a drive mechanism for driving rotation of the base and a fire ring circumscribing the fire source, the fire ring defining a surface. The surface includes a decorative cutout and a blade that extends from a plane defined by the surface, the blade configured to generate a circumferential airflow about the first source.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings certain embodiments. It should be understood, however, that the invention is not limited to the precise arrangements and instrumentalities shown.

In the drawings.

DETAILED DESCRIPTION OF THE INVENTION

Figure 1:
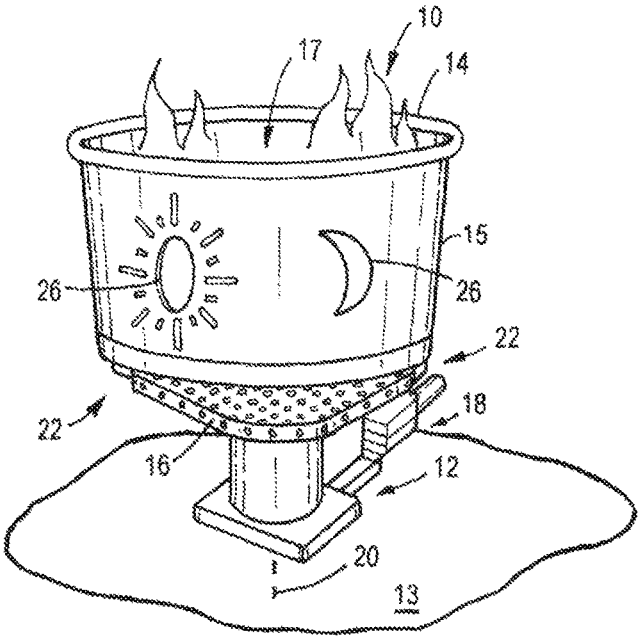
FIG. 1 is a perspective view of a rotating fire pit in accordance with a first preferred embodiment of the present invention.

Reference will now be made in detail to the present embodiments of the invention illustrated in the accompanying drawings which are preferred. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the identified element and designated parts thereof. Additionally, the term "a," as used in the specification, means "at least one." The terminology includes the words noted above, derivatives thereof and words of similar import.

In accordance with a first preferred embodiment illustrated in FIGS. 1-5, there is shown a rotating fire pit 10. The rotating fire pit 10 includes a base 12 which rests upon a ground surface 13, an enclosure or fire ring 14, and a drive mechanism 18. The rotating fire pit advantageously adds to the aesthetic experience of viewing a fire. By providing an enclosure through which decorative cutouts have been made, an external viewer is able to have the pleasurable experience of viewing flames through moving ornamentally shaped cutouts. The moving decorative cutouts add an effect of visual animation to a fire viewing experience.

Figure 2:
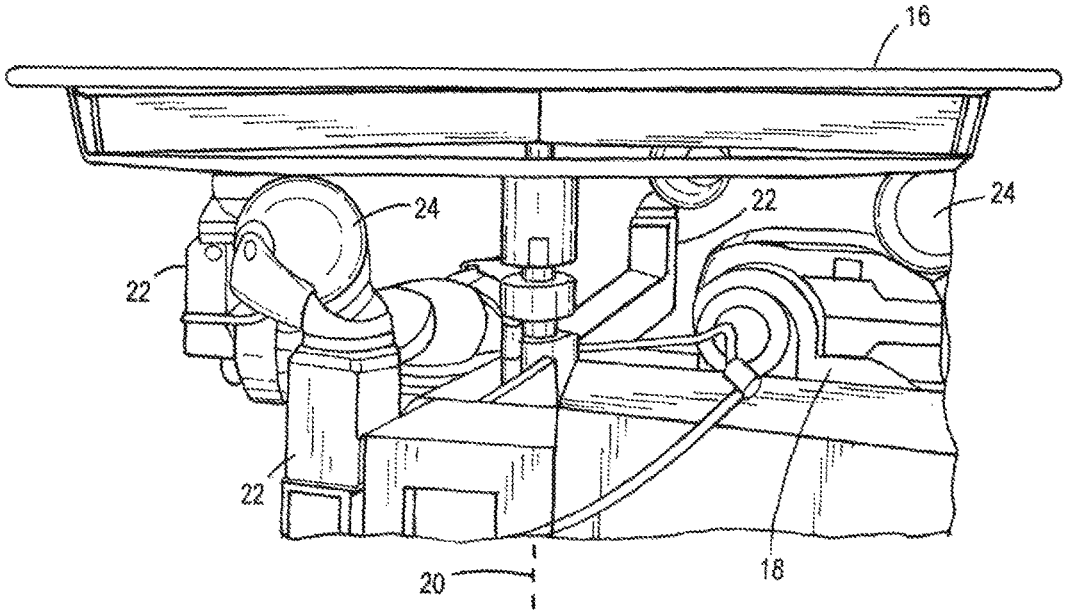
FIG. 2 is a partial perspective view of a base of the rotating fire pit of FIG. 1.
Figure 3:
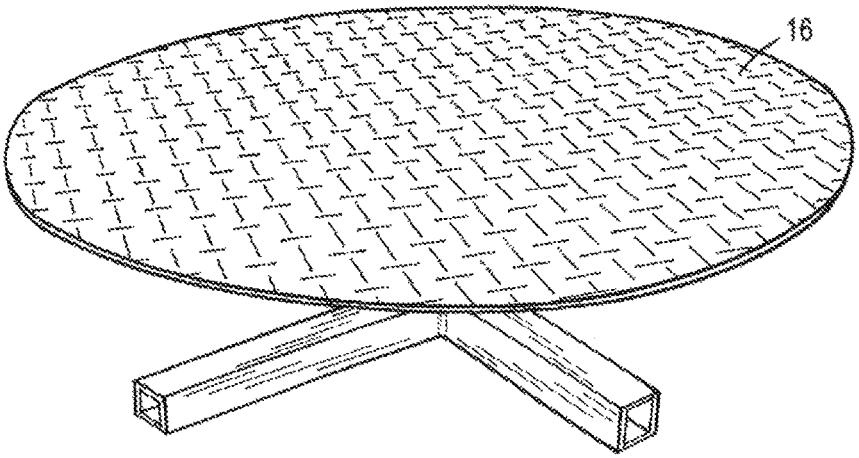
FIG. 3 is a perspective view of a floor of the base of the rotating fire pit of FIG. 1.
Figure 4:
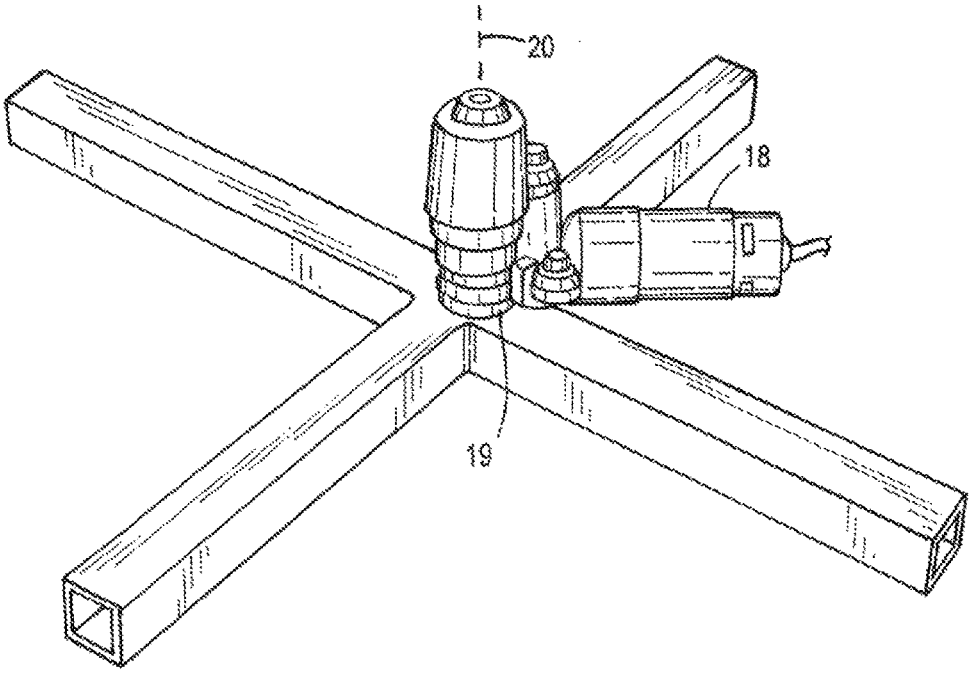
FIG. 4 is a perspective view of a motor and drive mechanism of the base of the rotating fire pit of FIG. 1.
Figure 5:
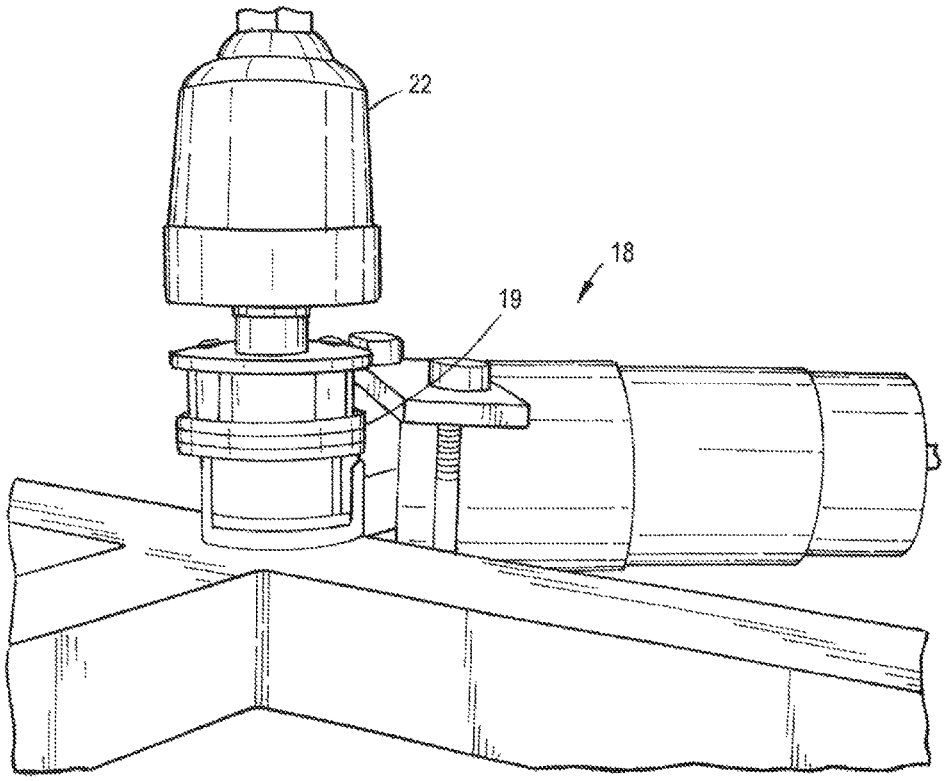
FIG. 5 is an enlarged partial perspective view of the drive mechanism of FIG. 4.

The base 12 is preferably configured as best shown in FIGS. 1 and 2 and supports a fire source 17. The base 12 includes a substantially planar floor 16 which is configured to support the weight and heat generated by the fire source 17, which may, for example be a small wood or charcoal fire or a gas fire or another source which is capable of generating a flame.

The base 12 can be made of an appropriate material to withstand exposure to heat from the fire source 17. Examples of such materials include metal, treated wood, certain high temperature plastic materials or the like. The base 12 may be formed to a design appropriate to the type of fire source in use. For example, in certain embodiments, the base 12 may be designed to promote air flow to the fire source 17 as well as providing appropriate support to keep kindling, logs, coal, or other fuel for the fire source in a specific location. In an embodiment in which the fire source 17 relies of an external fuel source such as a gas fire, the base 12 may have a hole through which a pipe runs in order to fuel the fire.

The base 12 also includes a drive mechanism 18 spaced from the floor 16 and the fire source 17. The drive mechanism can be a motor 18 configured to rotate the floor 16 about a central axis 20. The motor 18 is configured to provide rotation via a gear connected to the floor 16 which operates to rotate the floor 16. In accordance with an aspect of the present embodiment, the drive mechanism can be configured to include an angled gear 19 which translates rotational motion from the motor 18 to the central axis 20.

The drive mechanism 18, e.g. a motor, can be one of various types of motors capable of driving relative motion. Examples of such motors include: a thermoelectric generator, an electric motor (plug in, battery, or solar recharged), a pneumatic drive, a steam engine, or a magnetic drive mechanism. The motor 18 can be a motor driven by a battery or compressed air, a steam engine that is heated by the heat from a nearby heat source such as the fire source 17, or by a magnetic field that drives rotation of the base in a predetermined direction. In other embodiments the drive mechanism may be a mechanism such as a handle or a foot pedal that can assist an individual in driving relative motion between the base and a ground surface through manual force.

Further, other examples of the drive mechanism include an engine that is powered by the heat or thermal energy generated from the fire source within the rotating fire pit. That is, the drive mechanism may utilize the thermal energy generated by a fire source to power a motor to drive rotation of the enclosure of the rotating fire pit. For example, the drive mechanism may be a steam engine that includes a heat surface which is positioned in close proximity to the fire source. In such an embodiment the drive mechanism may be positioned in close proximity or in facing engagement with a bottom side of the floor of the fire pit. The floor which supports the fire source may be formed from a heat conductive material such as, but not limited to, diamond, silver, copper, gold, brass, aluminum, iron, steel, and lead. The heat generated by the fire source may be transferred through the base to the heat surface of the steam engine which may then heat water within the steam engine to generate steam.

Figure 9:
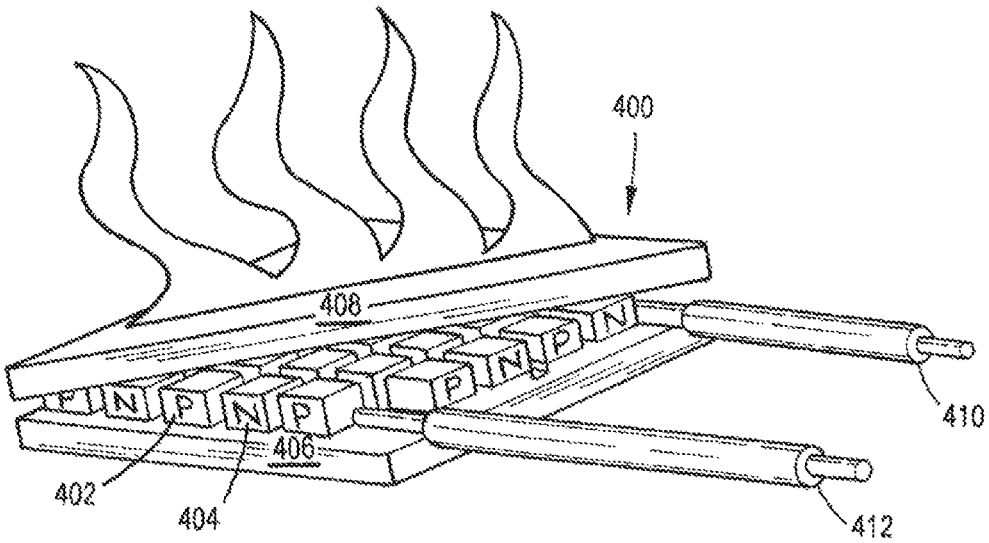
FIG. 9 is a schematic perspective view of a thermoelectric generator applicable to the various preferred embodiments of the rotating fire pit of the present invention.
Figure 9A:
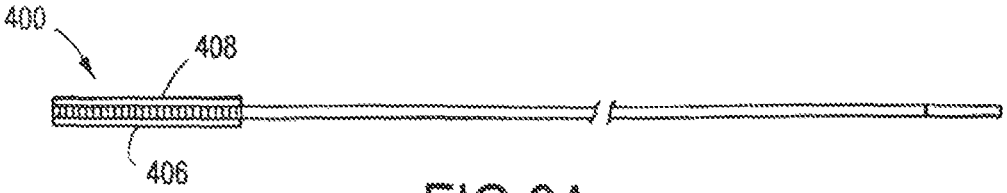
FIG. 9A is another schematic view of the thermoelectric generator of FIG. 9.

Referring to FIGS. 9 and 9A, in other embodiments, the drive mechanism for recycling heat to rotate the rotating fire pit may be a thermoelectric generator (TEG) 400 such as the TEG 200 manufactured by GMZ Energy of Waltham, Mass. The TEG 400 includes a cold side formed e.g., from a ceramic substrate and a hot side. P-type 402 and N-type semiconductor 404 pellets are sandwiched between the cold side 406 and the hot side 408. Electrodes 410 and 412 extend from the TEG for transmitting a voltage to a drive mechanism. A detailed description of a TEG applicable to the present embodiment is disclosed in U.S. Pat. No. 5,892,656, the entire disclosure of which is incorporated by reference herein in its entirety.

Once heated on the hot side and cooled on the cold side (with help from a heat sink) a TEG will generate a voltage difference and power (for example within 15 minutes time of the heat being applied), through the action of the Seebeck effect. Several TEGs coupled together and in thermal communication with the heat generated by the fire source within the fire pit can generate enough volts to power up a 12 VDC motor (such as a car windshield motor).

The floor 16 is further attached via one or more supports 22 to the enclosure 14. Each support 22 can be configured to slidingly engage with the floor 16, e.g. by bearings or rollers 24.

The enclosure or fire ring 14 is preferably configured as a cylindrical ring. While the term "ring" is used herein, it should be understood that such a fire ring can be formed to one of various shapes that perform the function of providing a shield between the fire source on the interior of the fire pit and an individual positioned outside of the fire pit. Examples of appropriate shapes include, for example, a cylinder, a cube, an oval, a square, a rectangle, a trapezoid, and the like. The enclosure 14 is connected to the floor 16 so as to move with and rotate with the floor 16. Such an attachment may be made via one or more conventional means or fasteners or connections.

The enclosure 14 may be coupled to the base of the fire pit. For example the coupling may be provided by supports which radiate from the base to the enclosure. In certain embodiments, the enclosure is mounted to the base by a support member that reaches from the base to the enclosure in order to translate rotational motion from the base to the enclosure.

The enclosure may function as a shield which provides protection from direct exposure to the flame generated by the flame source. Generally, such an enclosure provides a safety wall or screen before a fire source so as to limit the possibility of accidental (or intentional) danger through exposure to the fire source. Generally an enclosure is positioned between a fire source on the inside of the enclosure and individuals on the outside of the enclosure who may be enjoying the warmth and light generated by the fire.

Figure 10:
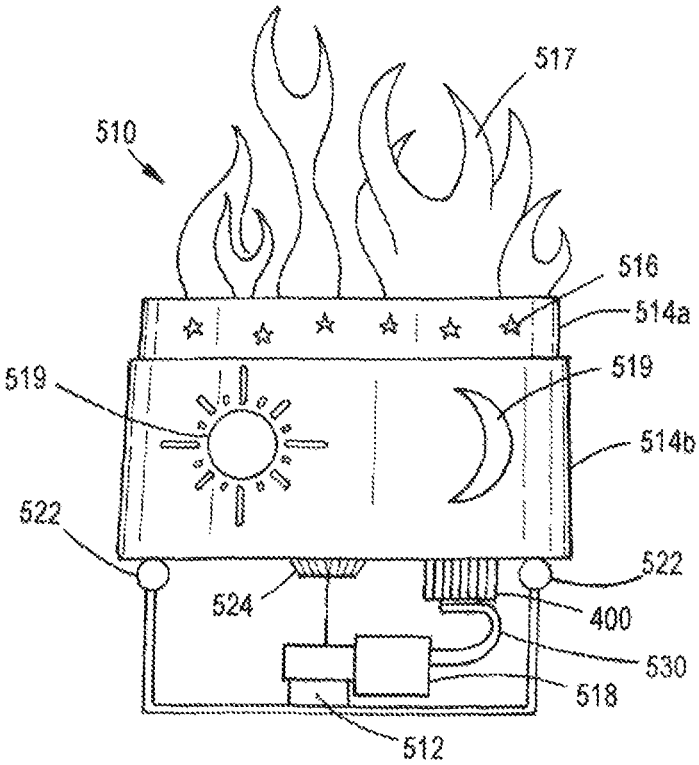
FIG. 10 is schematic view of a thermoelectric generator attached to a counter rotating fire pit in accordance with another preferred embodiment of the present invention.
Figure 10A:
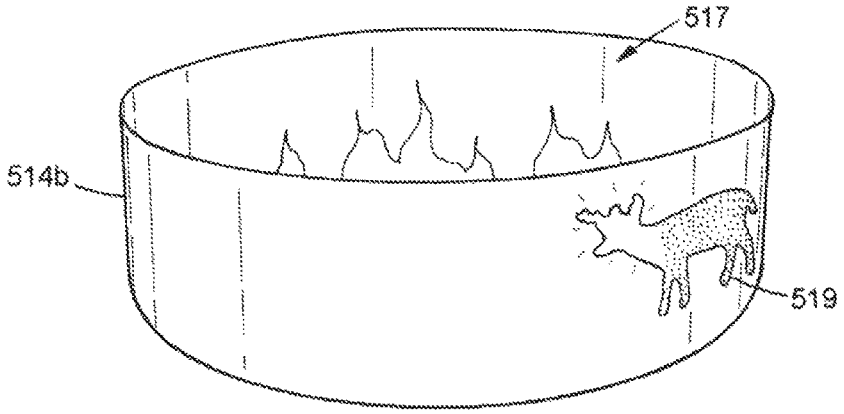
FIG. 10A-C is a series of perspective views illustrating certain features of a rotating fire pit in accordance with a preferred embodiment of the present invention as the rotating fire pit rotates.
Figure 10B:
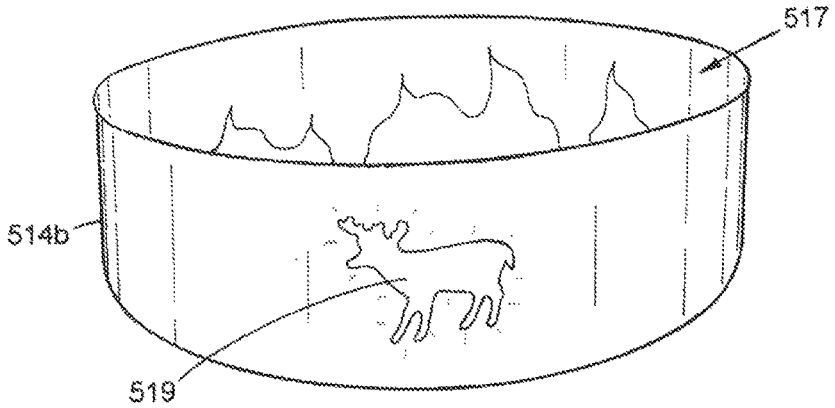
Figure 10C:
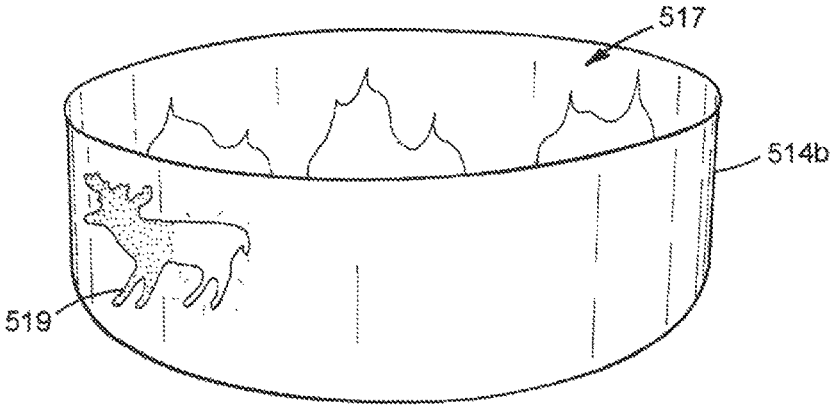

The enclosure 14 is made up of a wall 15 having a decorative cutout 26, an example of such cutouts are the cutouts in the shape of a sun and a moon respectively that are shown in FIG. 1 or an animal such as shown in FIGS. 10A-C. While the sun and the moon shapes are shown in FIG. 1 for illustration purposes, the decorative cutout 26 should be understood to be one or more of any of the numerous decorative designs that may be positioned on a wall such as the wall 15. In an embodiment consistent with this disclosure, the decorative cutout 26 should provide one or more transparent or translucent openings through the wall 15. In some examples of the enclosure 14, the decorative cutout 26 may be made of a plurality of individual cutouts each of which may be of different shapes or sizes. In alternative examples of the rotating fire pit 10 as disclosed herein the decorative cutout 26 or cutouts allow for the flow of air through the wall 15 of the enclosure 14. The wall 15 of the enclosure 14 provides a safety aspect to the fire pit 10 by limiting the possibility of dangerous exposure to flames generated by the fire source 17.

Figure 8:
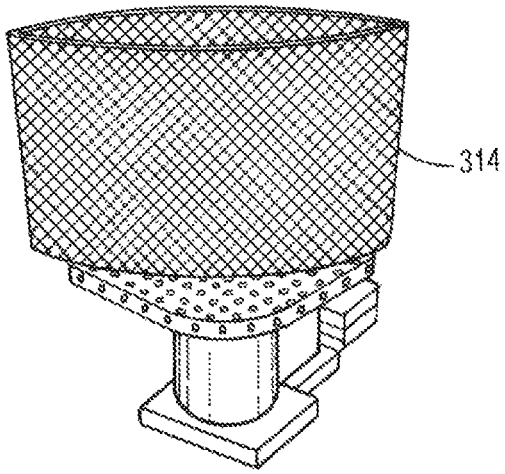
FIG. 8 is a perspective view of a rotating fire pit having a mesh enclosure in accordance with a fourth embodiment of the present invention.

The enclosure 14 may be made of an appropriate material to withstand exposure to heat to which it is exposed due to its proximity to the fire source. Examples of such materials include metal, treated wood, certain high temperature plastic materials or the like. In certain embodiments, the enclosure 14 may be a sheet of metal that has been formed in an appropriate shape. In certain embodiments the enclosure 14 may be formed as a mesh or a screen as illustrated in FIG. 8.

Various techniques for making a decorative cutout 26 in the enclosure 14 will suggest themselves to a practitioner. For example, a pair of metal snips may be used to cut away pieces of the enclosure to create the decorative cutout 26. In other examples welding or stamping equipment or similar devices may be used to create the decorative cutout 26. In other examples a cutout may be formed in the enclosure 14 at the time that the enclosure 14 is made. In other examples, the enclosure 14 may be assembled of a number of pieces of material which are organized so that the finished enclosure has one or more cutouts through which light may pass. In certain examples of an embodiment consistent with this disclosure, the cutout 26 itself may be composed of a mesh material, a glass, or a transparent or translucent plastic.

The enclosure 14 that includes the decorative cutout 26 in accordance with this disclosure will provide an aesthetic appearance when the enclosure 14 is positioned to circumscribe the fire source 17. For example, in one aspect of the rotating fire pit 10 as disclosed herein the cutout 26 may be shaped so as to represent a mustang galloping. In another embodiment the cutout 26 may be shaped to represent one or more celestial bodies such as suns, moons, stars, comets, or other such objects. Various choices as to decorative cutouts will suggest themselves to a practitioner. The decorative cutout or cutouts may include a variety of shapes and sizes and may vary in number and in shapes.

In certain embodiments the decorative cutout may extend beyond the top or bottom edges of the enclosure 14 or outward (or inward) from the surface of the wall of the enclosure. In other embodiments, the decorative cutout or cutouts may be selected to improve the flow of air through the walls of the enclosure or within the enclosure as it rotates with respect to the ground surface.

In alternative embodiments in accordance with the current disclosure the floor 16 may rotate in concert with the enclosure 14 or independently of the enclosure. The motor 18 may also couple directly to the enclosure 14 and thereby provide a rotating enclosure which moves independently of the floor 16. In such a configuration, the fire source 17 can rest directly on the ground surface 13. In other embodiments the floor 16 would not necessarily be required. It should be noted that such embodiments would include a drive mechanism configured to rotate the enclosure 14.

In an example of operation of the fire pit 10, the floor 16 and enclosure rotates. Rotation of the floor and enclosure is achieved by the drive mechanism 18. When operated with a wood fire, the walls of the enclosure also sever to retain burning wood within the fire pit. The rotation of the enclosure 14 provides for an individual positioned outside of the enclosure a view of an image of the decorative cutout 26 in motion. The motion of the decorative cutout 26 while illuminated by the glow generated by the fire source 17 within the fire pit 10 provides for an aesthetic view for such an individual. In other words, an animated visualization of the decorative cutout as a result of flame illumination by the fire source is provided.

Figure 6:
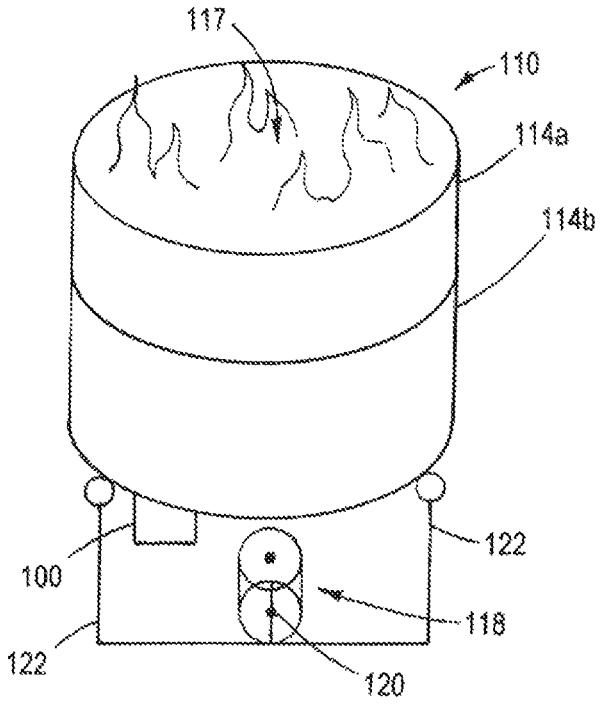
FIG. 6 is a schematic view of a rotating fire pit in accordance with a second preferred embodiment of the present invention.

FIG. 6 illustrates a schematic view of a rotating fire pit 110 in accordance with a second preferred embodiment of the present invention. The rotating fire pit 110 includes a steam engine 100 for providing power to drive the drive mechanism 118. The structure and operation of the steam engine 100 can include any conventional steam engine. Such structure and operation of steam engines are known in the art and a further detailed description of them is not necessary for a complete understanding of the present system. However, an exemplary steam engine applicable to the present system can include the steam engine as disclosed in U.S. Pat. No. 3,990,238, the entire disclosure of which is hereby incorporated by reference.

The rotating fire pit 110 also includes a pair of supports 122 and two enclosures 114*a*, 114*b*. The enclosures 114*a*, 114*b* in this embodiment rotate about a central axis 120 in opposite directions (e.g. counter-clockwise and clockwise, respectively), so that the two enclosures 114*a*, 114*b* are counter-rotating. A fire source 117 is also indicated as being contained within the two counter rotating enclosures 114*a*, 114*b*. The two enclosures 114*a*, 114*b* are positioned at different heights with respect to the fire source 117. For example, enclosure 114*a* can be configured to have an overall height greater than enclosure 114*b* and be positioned interior to enclosure 114*b*.

Figure 7:
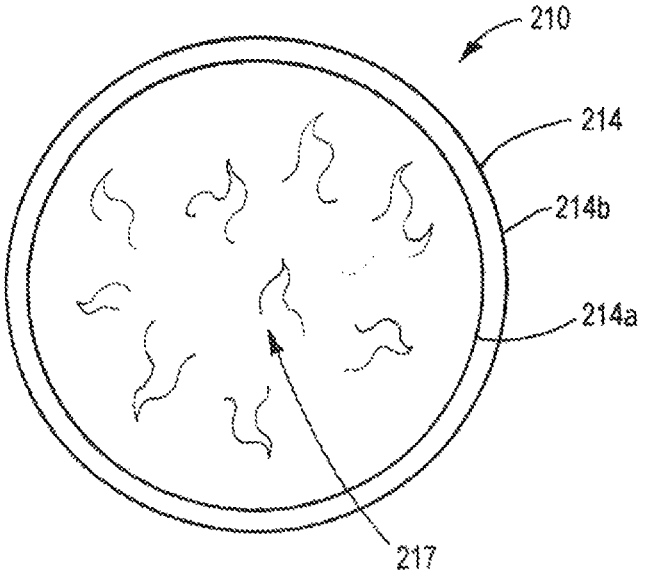
FIG. 7 is a schematic top plan view of an enclosure of a rotating fire pit in accordance with a third preferred embodiment of the present invention.

FIG. 7 is a schematic top plan view of an enclosure 214 of a rotating fire pit 210 in accordance with a third preferred embodiment of the present invention. The rotating fire pit 210 may optionally include a floor supporting a fire source 217. The enclosure 214 includes a pair of enclosure walls 214*a*, 214*b* (or fire rings). The fire source 217 is circumscribed by the first enclosure wall 214*a* and both the fire source 217 and the first enclosure wall 214*a* are circumscribed by the second enclosure wall 214*b*.

As shown in FIG. 7, the first enclosure wall 214*a* is at a first distance from a center of the rotating fire ring or a central longitudinal axis of the enclosure 214 and the second enclosure wall 214*b* is at a second distance that is greater than the first distance from the center of the rotating fire ring or the central longitudinal axis of the enclosure 214. Each of the two enclosure walls may be rotated in synchronized fashion or in independent fashion with respect to the other enclosure wall.

In other aspects of this embodiment in accordance with this disclosure there may be a first enclosure and a second enclosure, where the first enclosure and the second enclosure are placed at different heights with respect to the ground surface beneath the base of the fire pit. The two enclosures may rotate at different rates in order to provide an improved aesthetical experience for an individual viewing the fire pit. Where there are two or more vertically stacked enclosures various methods for driving the rotational motion of the enclosures will suggest themselves. For example each of the enclosures may be independently driven by supports which are connected to a drive mechanism or mechanisms.

Still, in other aspects of these embodiments of a rotating fire pit in accordance with this disclosure, a fire tornado can be created by the device. Such a device includes a base for supporting a fire source. Such a device also includes a drive mechanism for driving rotation of the base and an enclosure circumscribing the fire source, the enclosure including one or more decorative cutouts. When operating such a device to generate a fire tornado, the fire tornado may provide an aesthetically pleasing back light to the decorative cutout or cutouts.

In other embodiments in accordance with this disclosure where there is a first enclosure wall and a second enclosure wall, the fire pit includes a drive mechanism having a first gear to drive movement of the first enclosure wall and second gear to drive movement of the second enclosure wall. The relative rotational motion between the first enclosure wall and the second enclosure wall provides an animated visualization of the decorative cutouts in the two enclosure walls as a result of flame illumination provided by the fire source. It should be noted that in accordance with this disclosure each of the two enclosure walls may have its own independent drive mechanism.

In the configuration in which an enclosure has an independent drive mechanism each of the enclosure walls may follow a separate rotation (or no rotation at all) with respect to the other enclosure wall, the difference in rotation can be one of a variety of types. For example, a drive mechanism for an embodiment such as that illustrated in FIG. 7 may be configured such that only one of the outer enclosure wall 214*b* and the inner enclosure wall 214*a* rotate, or configured such that both the outer enclosure wall 214*b* and the inner enclosure wall 214*a* rotate at different speeds, or the inner enclosure wall and the outer enclosure wall rotate in a counter rotating manner with respect to each other. In such configurations, the relative rotation of the outer enclosure wall and inner enclosure wall, each of which have a respective one or more decorative cutouts, may create a coordinated moving image (or animation) which is apparent to an outer viewer when the rotating fire pit is in operation. In certain embodiments in accordance with this disclosure, the inner enclosure wall 214*a* and the outer enclosure wall 214*b* can each rotate and optionally rotate at different rates. In another example the inner enclosure wall may rotate and the outer enclosure wall may remain stationary, or the opposite configuration may be used.

In an embodiment where the first and the second fire rings or inner and outer enclosure walls are configured as counter rotating fire rings, the drive mechanism may include gears that run together with and operatively connect the drive assembly, as shown in FIG. 6, to turn one fire ring in one direction and the other fire ring the opposite direction. Each of the inner and outer enclosure walls can be configured with different sets of decorative cutouts so as to create a scene that comes together with a back light generated by the flames generated by the fire source within the rotating fire ring.

In certain embodiments of a rotating fire pit as described herein, a rotating fire pit may include a rotating base supporting a fire source and a vertically stacked pair of enclosures which circumscribe the fire source. In such embodiments a first enclosure is at a first distance in a plane defined by the base with respect to the fire source and a second enclosure is at the same distance in the plane defined by the base from the fire source, where the second enclosure is placed above or below the first enclosure.

While FIGS. 6, 7, and 10 specifically show two enclosures as part of a rotating fire pit it should be understood that any number of enclosure walls may be used to achieve an aesthetically pleasing fire pit in accordance with this disclosure.

Referring to FIG. 10, in accordance with another preferred embodiment there is shown a rotating fire pit 510. The rotating fire pit 510 includes a base 512 and a pair of enclosures or fire rings 514*a* and 514*b*. The inner enclosure 514*a* includes an inner decorative cutout 516. The outer enclosure 514*b* includes an outer decorative cutout 519. The base 512 supports a fire source 517. The base 512 includes a drive mechanism motor 518 spaced from the fire source 517. The motor 518 is configured to drive rotation of the outer enclosure 514*b*. In certain embodiments, the motor 518 may also drive rotation of the inner enclosure 514*a*. The motor 518 can be configured to provide rotation via counter rotating gears 524 connected to enclosures 514*a* and 514*b*.

The base 512 also includes supports 522 configured to slidingly engage with respect to one or each of the enclosures 514*a* and 514*b*. FIG. 10 also illustrates a TEG 400 in proximity to the fire source 517 and electrically connected via connections 530 with the motor 518.

In operation, the relative motion of the enclosure relative to the ground surface provides an external viewer with an animated visualization of the decorative cutout as a result of a flame illumination provided by the fire source. Such an animated visualization may be aesthetically pleasing to a viewer who watches the motion of the decorative cutout as it passes between the viewer and the flames provided by the fire source. In accordance with certain embodiments of the present disclosure the decorative cutout will have been designed or selected in order to maximize the aesthetically pleasing effect of the rotational motion of the enclosure.

For example, FIGS. 10A-C illustrate a series of views showing a rotating fire pit a various positions of rotation. The fire pit is shown rotating in a clockwise direction as illustrated in the figures such that the cutout 519 (in the shape of a moose) moves from right to left past an observer's viewpoint (i.e., from FIG. 10A to FIG. 10C).

As is known, a flame of a fire continuously moves in a dynamic fashion under the influence of a number of external factors, e.g., wind. This dynamic movement of a flame causes variations in luminescence to an observer. Accordingly, the fire source 517 of the rotating fire pit provides a luminescence that continuously changes. This in combination with a cutout 519 of a fire pit that rotates past the fire source 517 generates an animation of the cutout such that the cutout appears to move dynamically in addition to rotationally. That is, e.g., the moose cutout 519 will appear to be moving more than just a static cutout shape of moose moving in a rotating fashion along with the enclosure 514*b* of the fire pit. In other words, the static cutout shape will itself appear to be animated to the observer as a result of the variations in illumination of the fire source backlighting.

FIG. 10A illustrates the moose cutout 519 have a partially shaded portion (i.e., its right sided portion) representing an illumination of that part of the moose cutout being less (or non-existent) than an illumination of the unshaded portion (i.e., its left sided portion). As the moose cutout 519 moves to the position of FIG. 10B the entire cutout is fully illuminated by the fire source 517. Then as the moose cutout 519 moves to the position of FIG. 10C, the cutout 519 is again less illuminated on its left sided portion (represented by shading) and more illuminated on its right sided portion. The amount or degree of illumination of the cutout 519 and areas of more or less illumination passing through the cutout will continuously vary as a result of the combination of the flame illumination provide by the fire source backlighting and the rotational movement of the enclosure 514*b*.

As illustrated in FIG. 8, in accordance with another preferred embodiment, the enclosure may be composed of a mesh or screen 314. The mesh fire ring 314 allows for the flow of air to freely pass through its walls. The mesh fire ring 314, similar to the fire ring 14 shown in FIG. 1, should be understood to include at least one decorative cutout for being illuminated by the glow of the fire within the fire pit during operation.

The decorative cutout or cutouts are selected so that they preferably direct a flow of air into the interior of fire pit as the rotation of the enclosure causes the enclosure to rotate with respect to the relatively static external surrounding air.

The action of directing air into the interior of the fire pit coupled with the rotation of the enclosure induces a circumferential airflow about the fire source. Such a circumferential airflow about the fire source causes the air around the fire source to swirl or rotate around the axis defined by the fire source or a central longitudinal axis of the enclosure. The axis is defined by the fire source is generally an axis running vertically through the fire source in the direction of the flames generated by the fire source.

Such a device can generate an aesthetically pleasing visual of a fire tornado viewed through the decorative cutout. The rotation of the base may thus provide an animated visualization of the decorative cutout as a result of a flame illumination provided by the fire source.

In an example of such a device the rotating fire pit has a fire ring that circumscribes a small fire within the fire ring. As the fire pit rotates, the fire within the fire pit illuminates the decorative cutouts on the fire ring providing for anesthetic in view of moving images. Further, as a result of the decorative cutouts allowing for the flow of air through the walls of the fire ring, air itself flows through the fire ring in a circumferential matter thereby providing for a circular flow of air within the fire ring and thereby providing for a tornado effect on the flames within the fire pit such that the flames of the fire within the fire pit are directed centrally to a rotational axis of the rotating fire pit and rotationally with respect to the rotating fire pit.

In sum, the rotating fire pit in accordance with the embodiments of this disclosure, there is a fire ring that circumscribes a small fire within the fire ring. As the fire pit rotates, the flames from the fire source within the fire pit illuminate the decorative cutouts on the fire ring. The flame illuminated decorative cutouts provide for an aesthetic view of visual animations. Further, in other aspects of the present invention, as result of the decorative cutout or cutouts allowing for the flow of air through the walls of the fire ring, air itself flows through the fire ring in a circumferential matter thereby providing for a circular flow of air within the fire ring and thereby providing for a tornado effect on the flames within the fire pit such that the flames of the fire within the fire pit are directed centrally to a rotational axes of the rotating fire pit and rotationally.

Figure 11:
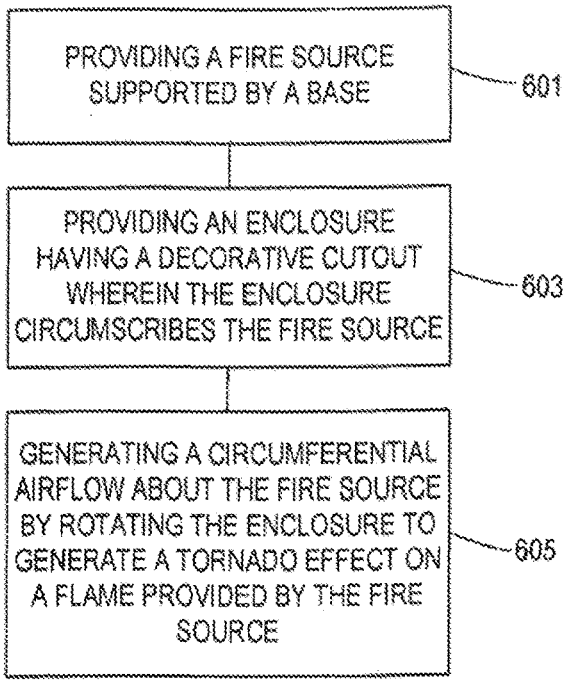
FIG. 11 is a flow chart of a series of steps involved in a method for generating a fire tornado in accordance with another preferred embodiment of the present invention.

Referring to FIG. 11, there is illustrated a flow diagram of a method as described herein; the method operates to create a fire tornado through the performance of a series of steps. The method includes step 601 of providing a fire source supported by a base and step 603 of providing an enclosure having a decorative cutout, wherein the enclosure circumscribes the fire source. The method further includes step 605 of generating a circumferential airflow about the fire source by rotating the enclosure thereby generating a tornado effect on a flame provided by the fire source.

Figure 12:
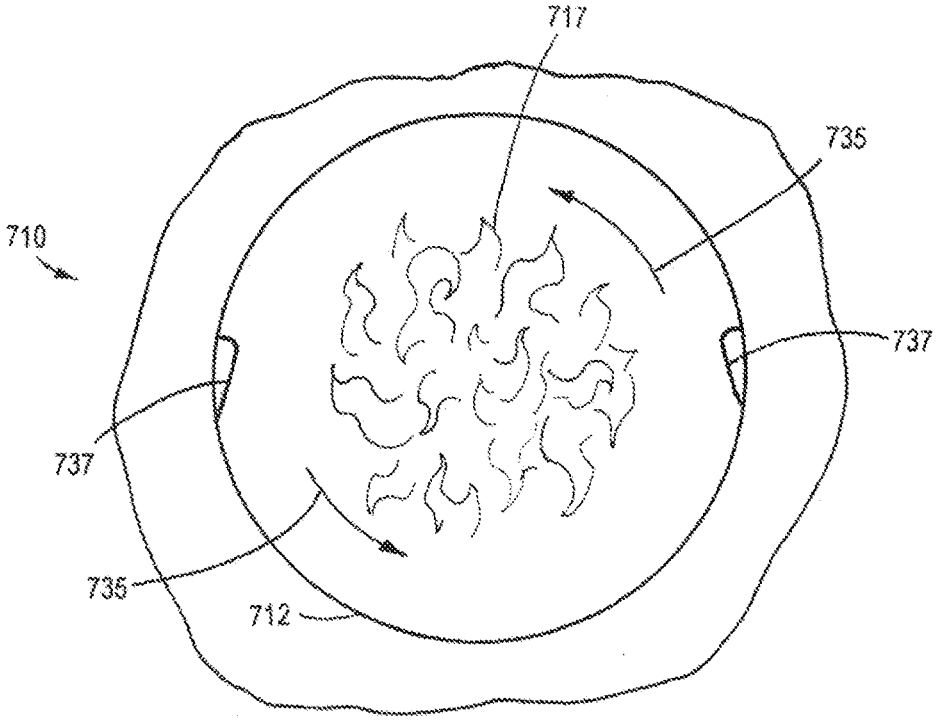
FIG. 12 is a schematic top plan view of a rotating fire pit having two blades in accordance with another preferred embodiment of the present invention.

Referring to FIG. 12, there is shown a rotating fire pit 710 in accordance with another preferred embodiment of the present invention. The rotating fire pit 710 is similar to the fire pit 10 but includes one or more protrusions 737. The protrusions 737 can extend either inwardly (as shown) or outwardly and proud of the wall surface. The protrusions 737 can also be extension of the decorative cut outs, such as e.g., wings on a horse cutout. Further, the protrusions can be configured to generate or promote a flow of air within the fire pit to produce a fire tornado.

The positioning, size, and design of the protrusion 737 can be selected in order to increase the effectiveness and efficiency with which relative motion between the floor and the enclosure generates circumferential airflow about the fire source 717. Such a circumferential airflow is illustrated by lines 735 which indicate the direction of the circumferential airflow achieved by the embodiment illustrated in FIG. 12. It should be noted that, as a top view, FIG. 12 does not show a decorative cutout but a decorative cutout should be understood to be included in the enclosure 737. The positioning, size, and design of the protrusions 737 may be selected in order to act in concert with a decorative cutout made in the enclosure 712.

It will be appreciated by those skilled in the art that changes could be made to the embodiments described above without departing from the broad inventive concept thereof. For example, additional components and steps can be added to the various embodiments of the rotating fire pit. It is to be understood, therefore, that this invention is not limited to the particular embodiment disclosed, but it is intended to cover modifications within the spirit and scope of the present invention as defined by the appended claims.

I claim:

1. A fire pit configured to support a sustainable campfire comprising:

a continuously solid base for supporting the sustainable campfire;

an enclosure having a sealed bottom extending from the base, the enclosure having a wall that includes a decorative cutout and an open top; and a drive mechanism that drives motion of at least one of the enclosure and the base relative to a ground surface and is positioned between the sealed bottom of the base and the ground surface, wherein the drive mechanism comprises a motor and the motor is powered by heat generated by the sustainable campfire.

2. The fire pit of claim 1, wherein the enclosure is mounted to the continuously solid base.

3. The fire pit of claim 1, wherein the enclosure if a fireproof fire ring.

4. The fire pit of claim 1, wherein the motor is a thermoelectric generator, a pneumatic drive, or a steam engine.

5. The fire pit of claim 1, wherein relative motion of the continuously solid base relative to the ground surface provides an animated visualization of the decorative cutout as a result of a flame illumination provided by the sustainable campfire.

6. A rotating fire pit configure to support a campfire-like fire source comprising:

a closed continuously solid base configured to withstand exposure to the campfire-like fire source;

a first fire ring circumscribing the closed continuously solid rotating base, the first fire ring including a first decorative cutout and a sealed bottom end; and a drive mechanism that drives motion of the first fire ring and the closed continuously solid base relative to a ground surface, wherein the drive mechanism comprises a motor and the motor positioned below the sustainable campfire and is powered by heat generated by the sustainable campfire.

7. The rotating fire pit of claim 6, wherein the first fire ring is mounted to the closed continuously solid rotating base.

8. The rotating fire pit of claim 6, further comprising: a second fire ring spaced from the first fire ring and circumscribing the closed continuously solid rotating base, the second fire ring including a second decorative cutout.

9. The rotating fire pit of claim 8, wherein the drive mechanism that includes a first gear to drive the first fire ring and a second gear to drive the second fire ring, wherein the drive mechanism is configured to drive relative rotational motion between the first fire ring and the second fire ring.

10. The rotating fire pit of claim 9, wherein the relative rotational motion between the first fire ring and the second fire ring provides an animated visualization of the second decorative cutout as a result of a flame illumination provided by the campfire-like fire source.

11. A device for creating a fire tornado comprising:

a continuously solid base having a fire source;

a fire ring circumscribing the fire source, the fire ring including at least one protrusion extending inwardly from the fire ring for generating air flow upon rotation of the continuously solid base and a decorative cutout and a sealed bottom end; and a drive mechanism for driving rotation of at least one of the base and fire ring.

12. The device of claim 11, wherein the decorative cutout induces a circumferential airflow about the continuously solid base.

13. The device of claim 12, wherein the circumferential airflow through the decorative cutout provides a tornado effect on a flame of a size and intensity sufficient to withstand the circumferential airflow, where the flame is generated by the fire source.

14. The device of claim 11, wherein the rotation off the continuously solid base provides an animated visualization of the decorative cutout as a result of a flame illumination provided by the fire source.

15. A method for creating a fire tornado, comprising:

providing a sustainable fire source supported by a base;

providing an enclosure having a decorative cutout, wherein the enclosure includes at least one protrusion extending inwardly from the enclosure and circumscribes the fire source; and generating through the use of the at least one protrusion extending inwardly a circumferential airflow about the fire source thereby generating a tornado effect on a flame provided by the fire source.

16. The device of claim 11, wherein the fire ring rotates independently of the continuously solid base.

17. The fire pit of claim 1, wherein one of the continuously solid base and enclosure rotates independently of the other of the enclosure and the continuously solid base.

18. The method of claim 15, wherein the sustainable fire source generates a flame of a size and intensity sufficient to withstand the circumferential airflow.

* * * * *